United States Patent [19]

Madore

[11] Patent Number: 5,076,191

[45] Date of Patent: Dec. 31, 1991

[54] COMPARTMENTATION FOR SKI-TYPE WATER CRAFT

[75] Inventor: Christopher L. Madore, Cypress, Calif.

[73] Assignee: Wet-Ski, Inc., Cypress, Calif.

[21] Appl. No.: 661,459

[22] Filed: Feb. 26, 1991

[51] Int. Cl.[5] ..... B63B 17/00

[52] U.S. Cl. ..... 114/270; 114/343

[58] Field of Search ..... 114/343, 364, 270; 440/38

[56] References Cited

U.S. PATENT DOCUMENTS

| | | | |
|---|---|---|---|
| 3,687,344 | 8/1972 | Nixon | 224/29 R |
| 3,958,289 | 5/1976 | Carlson . | |
| 3,986,574 | 10/1976 | Irvine | 180/54 A |
| 4,569,301 | 2/1986 | Pyburn | 114/364 |
| 4,593,642 | 6/1986 | Shay | 114/364 |
| 4,690,237 | 9/1987 | Funabashi et al. | 180/219 |
| 4,724,791 | 2/1988 | McSorley | 114/364 |
| 4,756,455 | 7/1988 | Kitner et al. | 224/42.11 |
| 4,848,626 | 7/1989 | Waters | 224/273 |
| 4,909,176 | 3/1990 | Kobayashi | 114/343 |
| 4,936,241 | 6/1990 | Hendrickson | 114/364 |
| 5,005,509 | 4/1991 | Williams | 114/364 |

FOREIGN PATENT DOCUMENTS

| | | | |
|---|---|---|---|
| 217511 | 4/1987 | European Pat. Off. | 114/364 |

*Primary Examiner*—Jesus D. Sotelo
*Assistant Examiner*—Stephen P. Avila
*Attorney, Agent, or Firm*—Laney, Dougherty, Hessin & Beavers

[57] ABSTRACT

A safe, dry storage compartment for use in combination with a jet ski water craft, the compartment being adapted for secure affixure to the top surface of a jet ski guide arm. The compartment consists of a mounting structure that is adapted for secure affixure to the guide arm and which is further formed to include a storage container of elongate volume. A hinged container cover is then secured over the elongate container opening and locked closed in sealed relationship to protect personal valuables, dry matter and the like stored within the compartment container.

8 Claims, 2 Drawing Sheets

COMPARTMENTATION FOR SKI-TYPE WATER CRAFT

BACKGROUND OF THE INVENTION

1. Field of the Invention

The present invention relates to attachable compartmentation for use with ski-type water craft and, more particularly, but not by way of limitation, it relates to a novel form of water-tight compartment that can be attached to the guide arm of a jet ski craft to provide dry storage of valuables, food and clothing items, etc.

2. Prior Art

Jet ski craft have been a very popular water sport machine for a number of years and, in general, little or no attention has been given to dry storage on or about such craft. Some prior types of ski water craft have made provision for a small water tight storage compartment for the purpose of storing fire extinguishers, tools and other emergency equipment but such compartmentation was placed in relatively inaccessible or difficult to enter compartment spaces, and size was kept to a minimum such that only the intended equipment would be contained. The U.S. Pat. No. 4,756,455 in the name of Kitner et al. teaches a saddle bag-type of storage space for use on water craft. This patent teaches a utility saddle bag that is configured to fit snugly over the engine compartment of a jet-propelled water craft. A number of side pockets then provide space for storage and a closure strap secures the pockets to prevent loss of stored items.

Another U.S, Pat. No. 4,909,176 in the name of Kobayashi relates to a jet propelled type of boat or ski craft that includes removable side containers that are rigidly secured at water-line level and which also act as sponsons. The containers are secured to the sides of the hull by means of screw fasteners and they serve to provide both water-proof storage and additional buoyancy. Numerous other types of box or compartment as devised for specific use with such as snow mobiles, motorcycles, canoes and the like were discovered in prior art searching; however, there is no known teaching of a water-tight compartment of similar construction and design considerations as those of the present invention.

SUMMARY OF THE INVENTION

The present invention relates to a sealable, water-tight storage compartment for use in combination with a jet ski water craft. The compartment is formed by plastics molding as an elongated mounting structure that includes a rectangular container or storage space with a sealable container cover hingedly secured thereover. The mounting structure is of elongate form with aesthetically pleasing external lines, and a wrap-around mounting flange provides a seating for secure placement of the mounting structure on the mid-portion of the guide arm of the ski craft.

Therefore, it is an object of the present invention to provide an easily accessible dry storage space on a jet ski water craft.

It is also an object of the present invention to provide a compartment attachment device that is aesthetically pleasing as well as functional.

It is yet further an object of the invention to provide a water-tight storage compartment that is placed in a non-interfering area aboard a jet ski craft.

Finally, it is an object of the present invention to provide compartmentation for storage of valuables, dry clothing, food items, etc. in addition to any storage compartmentation provided for operational or emergency items.

Other objects and advantages of the invention will be evident from the following detailed description when read in conjunction with the accompanying drawings that illustrate the invention.

DETAILED DESCRIPTION OF THE INVENTION

Figure 1:
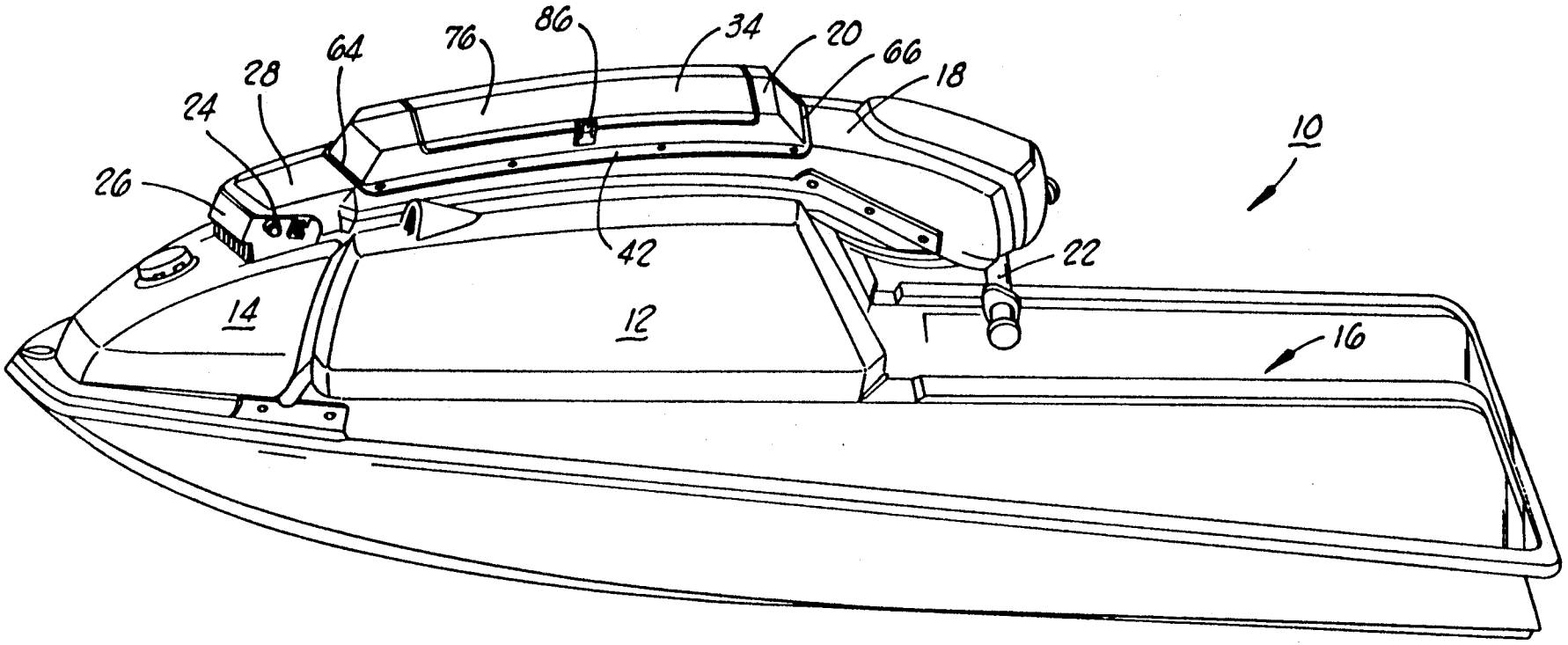
FIG. 1 is a side view in perspective of a jet ski water craft with compartment secured on the guide arm.

Referring to FIG. 1, a typical type of jet ski 10 includes a motor cowl 12, fuel tank 14, platform 16 and guide arm 18. A water-tight compartment 20 is secured generally centrally on top of guide arm 18. Guide arm 18 includes the control handle bars 22 which are movable up and down as guide arm 18 is movable about a pivot pin 24 in guide arm bracket 26. A top surface 28 of guide arm 18 is generally flat and capable of receiving the water-tight compartment 20 in secure seating.

Figure 2:
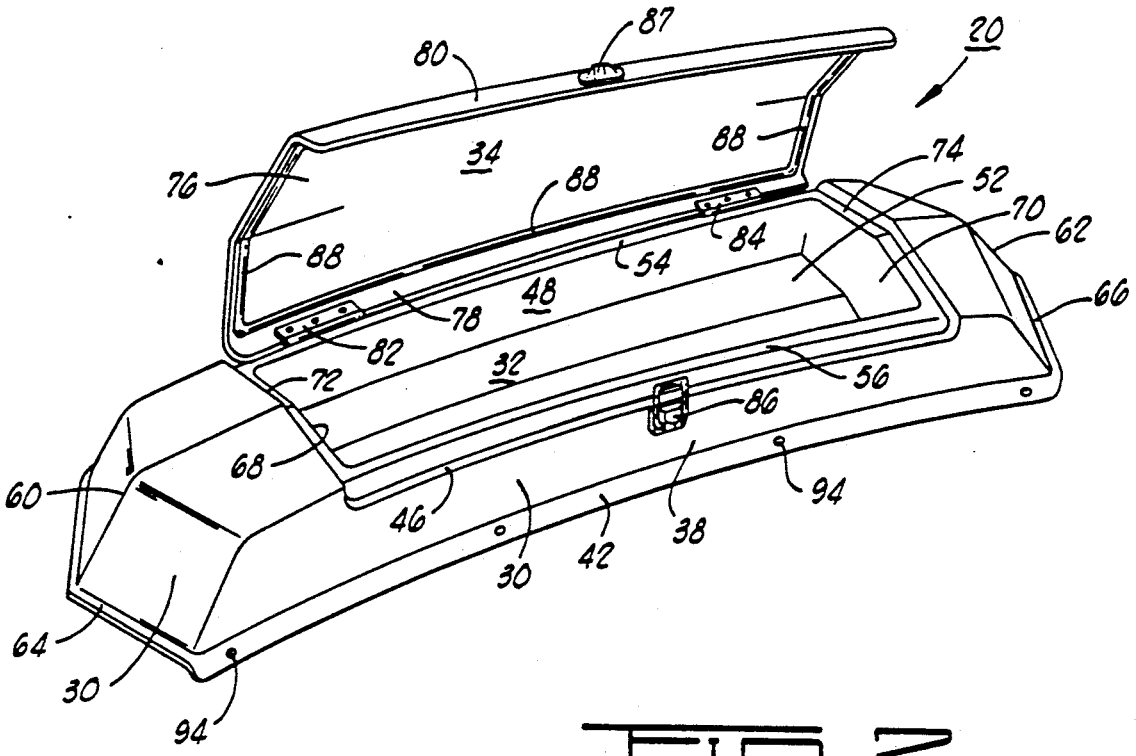
FIG. 2 is a perspective view of the compartment of the present invention with the container cover open.
Figure 3:
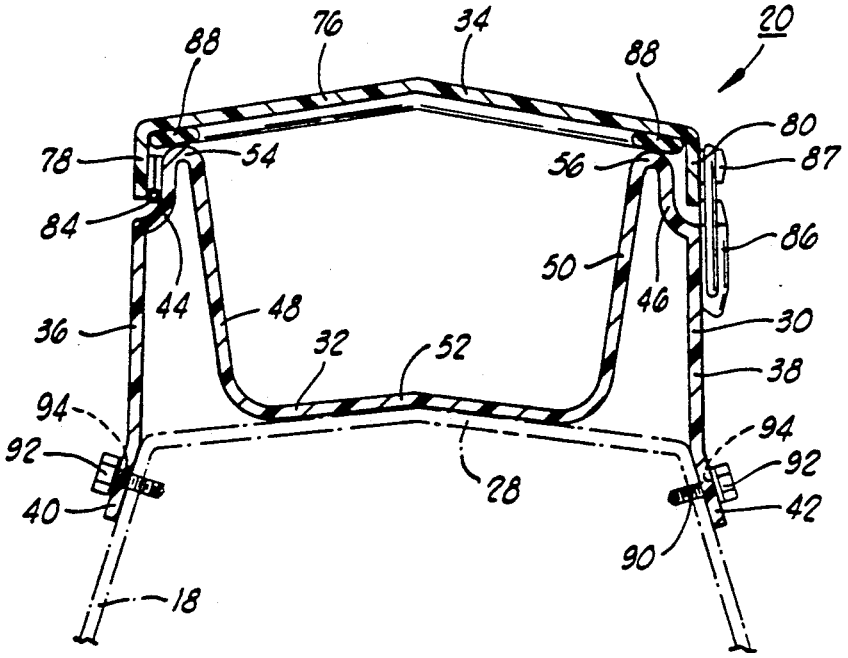
FIG. 3 is a cross section through a compartment constructed in accordance with the present invention.

Referring to FIGS. 2 and 3, the compartment 20 consists of a mounting structure 30 having a downwardly formed container 32 formed therein, and having a container cover 34 positionable to enclose the compartment 20. The mounting structure 30 with container 32 are preferably formed from a suitable plastic by a process of vacuum forming. Thus, as shown in FIG. 3, the mounting structure 30 includes opposite outer walls 36 and 38 extending into opposite mounting flanges 40 and 42, respectively. The opposite container walls 36 and 38 are then formed inwardly as arcuate channels 44 and 46, respectively, whereupon the formation is reversed to form the opposite side walls 48 and 50 of container 32. The bottom 52 of container 32 is then continuously formed, and it may be formed with a suitable bend or break to complement any shape or formation in the top surface 28 of the particular guide arm 18.

The inward reversal of container side walls 48 and 50 provides formation of the container edge, i.e., opposite edges 54 and 56, respectively. As shown in FIG. 2, the front and back sections of mounting structure 30 are aesthetically formed as a nose wall 60 and a rear wall 62 with forward and rear mounting flanges 64 and 66 which join continuously with side mounting flanges 40 and 42 to provide a complete wrap-around mounting flange. The interior container 32 is also formed to include the front and rear end walls 68 and 70, respectively.

The upper container edges 54 and 56 are joined by contiguous end edges 72 and 74 to provide positive seating around the perimeter of container cover 34. The container cover 34 is formed with an upper panel 76 and opposite side flanges 78 and 80. A pair of suitable hinges 82 and 84 are secured as by riveting to hingedly affix the container cover 34 from arcuate recess 44 to cover side flange 78. On the opposite side, cover side flange 80 is adapted for locking enclosure within arcuate recess 46 by means of a suitable swing latch lock 86 and catch 87. Actually, the lock 86 may be any of several types of quick action lock suitable for the purpose and it may be easily secured by conventional fasteners. A sealing element in the form of a rectangular elastomer gasket 88 is secured about the inner surface of container cover 34, i.e., in position to press tightly over edges 54, 56, 72 and 74 when cover 34 is closed and locked.

The entire compartment 20 may be secured on guide arm 18 by any of various fastening means; however, a recommended method is the drilling of plastic housing to form drill holes 90 and then insertion of self-tapping machine screws 92 through the plurality of screw holes 94. It is also contemplated that other fastening means such as straps or VELCRO® tape combinations may be utilized, the particular choice of fastener being dictated by the exigencies of the application.

The foregoing discloses a novel form of dry storage compartment for use in combination with a jet ski craft, more specifically, as mounted on the upper surface of the guide arm of the jet ski craft. The device is of streamlined profile such that it offers little or no resistance in addition to the normal jet ski resistance during spills and rolls of the equipment, yet the compartment has very positive locking and sealing capabilities that preserve the water-free integrity of the stored components, food, personal items, etc.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. A water-tight compartment for use in combination with a jet ski craft, comprising:

a guide arm which is an integral part of the jet ski craft, said guide arm being an elongated, vertically pivotable member having a generally flat top surface;

an elongated mounting structure defining an elongated container having front and back walls, opposite side walls and bottom, said mounting structure being formed to extend opposite side mounting flanges;

securing means for fastening the mounting structure opposite side mounting flanges onto the guide arm top surface; and container cover means hingedly affixed to said mounting structure to sealingly enclose said elongated container.

2. A water-tight compartment as set forth in claim 1 which is further characterized to include:

locking means for securing the container cover means in sealed enclosure over said elongated container.

3. A water-tight compartment as set forth in claim 1 wherein said securing means comprises:

a plurality of threaded fasteners.

4. A water-tight compartment as set forth in claim 1 which is further characterized to include:

a sealing gasket of resilient material secured around the inside of said container cover means and disposed to contact the elongated mounting structure thereby to seal the elongated container.

5. A water-tight compartment as set forth in claim 4 which is further characterized to include:

a pair of hinges securing said container cover means to said mounting structure; and locking means maintaining the container cover means in sealed closure.

6. A water-tight compartment as set forth in claim 1 wherein:

said elongated mounting structure with opposite side mounting flanges and elongated container is unitarily formed.

7. A water-tight compartment as set forth in claim 6 which is further characterized to include:

a sealing gasket of resilient material secured around the inside of said container cover means and disposed to contact the elongated mounting structure thereby to seal the elongated container.

8. A water-tight compartment as set forth in claim 7 which is further characterized to include:

locking means maintaining the container cover means in sealed closure.

* * * * *